United States Patent [19]

Dechirot

[11] Patent Number: 4,760,927

[45] Date of Patent: Aug. 2, 1988

[54] LINEAR DISPLAY CABINET

[75] Inventor: Jean-Pierre Dechirot, Balan, France

[73] Assignee: Societe Vynex SA, France

[21] Appl. No.: 77,947

[22] Filed: Jul. 24, 1987

Related U.S. Application Data

[63] Continuation of Ser. No. 871,400, filed as PCT FR85/00240 on Sep. 9, 1985, published as WO86/01699 on Mar. 27, 1986, abandoned.

[30] Foreign Application Priority Data

Sep. 12, 1984 [FR] France ..... 84 14016

[51] Int. Cl.[4] ..... A47F 7/00

[52] U.S. Cl. ..... 211/54.1; 211/133

[58] Field of Search ..... 211/54.1, 59.2, 59.3, 211/52, 51, 57.1, 133; 312/50, 71; 40/124, 124.2, 907, 491

[56] References Cited

U.S. PATENT DOCUMENTS

| | | | |
|---|---|---|---|
| D. 123,126 | 10/1940 | Howell et al. | 211/54.1 X |
| 3,092,257 | 6/1963 | Rountree | 211/49.1 |
| 4,072,246 | 2/1978 | Paulin | 211/57.1 X |
| 4,217,713 | 8/1980 | Greenberger | 40/491 X |
| 4,475,658 | 10/1984 | Roberts | 211/54.1 |
| 4,611,866 | 9/1986 | Everett | 211/189 X |

FOREIGN PATENT DOCUMENTS

| | | |
|---|---|---|
| 3116145 | 11/1982 | Fed. Rep. of Germany . |
| 1380109 | 10/1964 | France . |
| 2137398 | 12/1972 | France . |
| 2527913 | 12/1983 | France . |

*Primary Examiner*—Robert W. Gibson, Jr.
*Assistant Examiner*—Blair M. Johnson
*Attorney, Agent, or Firm*—Lerner, David, Littenberg, Krumholz & Mentlik

[57] ABSTRACT

This sales display unit principally comprises downward-inclined pegs (2), in its upper region, and upward-inclined pegs (4) in its lower region. A rearwardly-inclined fascia element (7) separates the spaces (1 and 3) occupied by each type of peg, which are extended, upwards and downwards respectively, by a forwardly-inclined fascia element (10) and a hinged fascia element (13). The sales front of the lower space (3) is rearwardly inclined, and the packages which are hung on the corresponding pegs (4) are subjectd to upward returning forces, exerted by springs (5). Each of the fascia elements is equipped with supplementary means of information, and may be utilized for displaying advertizing media.

7 Claims, 1 Drawing Sheet

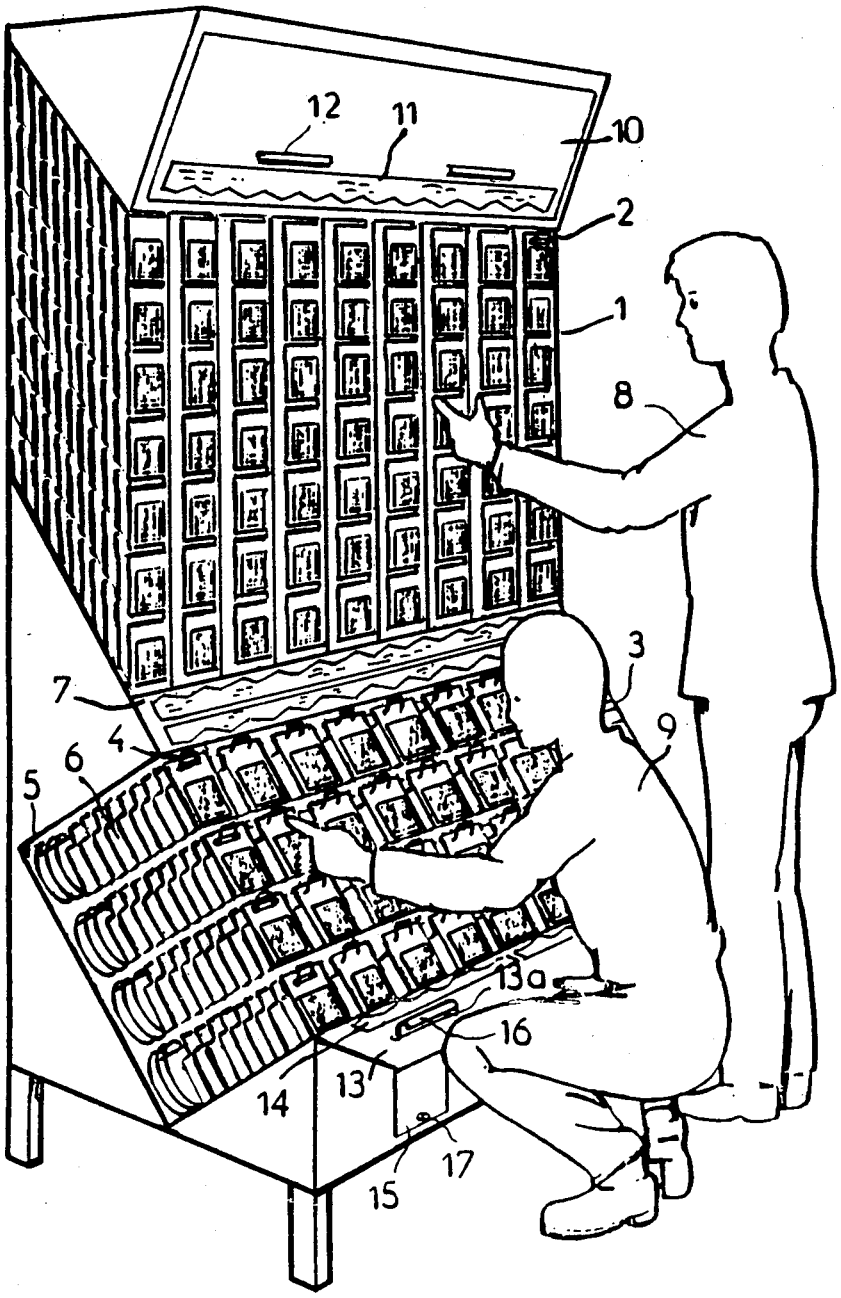
12
11
10
2
1
8
3
9
7
4
6
5
13a
16
14
13
17
15

LINEAR DISPLAY CABINET

This is a continuation of application Ser. No. 871,400 filed as PCT FR85/00240 on Sep. 9, 1985, published as WO86/01699 on Mar. 27, 1986, now abandoned.

The invention relates to a linear sales display unit for products which are packaged in bags, or on cards, or in boxes, and which are hung on pegs by means of perforated tabs.

Linear sales display units corresponding to the above definition already exist. They are used, in the main, for self-service sales of various articles, in large-area retail stores. The present disclosure relates to sales display units which are open at the front, and which are provided, on their rear walls, with pegs, of either single-limb or twin-limb design, fixed either horizontally or with a certain downward inclination in order to bring about, by gravity, the continuous return of the packages into contact with the tip of the peg. In certain cases, the same advantage is obtained on horizontal pegs, by fitting them with a spring operated forward return device, such as the one described in French patent document No. 2. 527 913.

The pegs which are inclined downwards, or which are fitted with a return spring, enable a continuous front of products to be maintained, irrespective of the removal rate. However, these devices are capacity-limited by the push force which is exerted on the first packages in each row when the pegs are fully loaded and, in situ, by commercial considerations, since the articles which are situated at eye level and at hand level sell better than those which necessitate an additional, physical action; the same considerations applying, moreover, to the sales display units which are fitted solely with horizontal pegs, rendering illusory not only the utilization of the space up to approximately 0.80 of a meter above the floor, but also the utilization of the space situated higher than approximately 1.80 meters; the result of which is that present-day sales display units are endowed with an effective sales front which is only approximately 1 meter high, since the bottom portion of the display unit is generally reserved for the presentation of articles which are sold in bulk, and which cannot be hung on pegs.

It must also be added that, on present-day sales display units, there are relatively few means of information for facilitating product selection, save for the dimensional characteristics which appear on the package hanger-tabs, and this shortcoming forces the purchasers to seek this information from the staff of the self-service store, who do not always possess the necessary competence.

The object of the present invention is to remedy these disadvantages. The invention, as characterized in the claims, solves the problem posed by the production, for the first time, of a sales display unit for products which are presented on pegs, this display unit permitting the rational utilization of a more extensive sales front, which is of uniform length, which facilitates the selection, location, identification and removal of the products, in the minimum time and with the minimum of effort, and which lends itself to the building-up of complete product sales sections, according to a modular concept, each corresponding to a well defined field of activity.

In its upper region, this sales display unit comprises pegs which are inclined downwards, while its lower region contains pegs which are inclined upwards, and which are fitted with return springs. A fascia element, carrying data and supplementary means of information relating to the products on display, separates the spaces which are respectively occupied by the downward-inclined pegs and the upward-inclined pegs, and these spaces are extended, upwards and downwards respectively, by fascia elements carrying data and supplementary means of information relating to the products on display. The bags, cards or boxes are grouped together, according to the field of use of the products which they contain, in the sub-spaces which each adjoin one of the fascia elements, the fascia element in question carrying information indicating the field of use of the products presented in the said sub-spaces. The fascia elements and the sales fronts are lit.

The fascia elements are utilized for displaying advertizing media, which may be static, mechanical, dynamic and/or electronic. The space behind the fascia elements is utilized for housing animation systems, information systems and instructional systems. The sales front of the products presented on the downward-inclined pegs is arranged to be vertical, while that of the products presented on the upward-inclined pegs is rearwardly inclined at an angle of approximately 45 degrees. The sales front corresponding to each of the sub-spaces forms a rectangle or a square, with a side dimension not exceeding 0.60 of a meter. The top-located fascia element is forwardly inclined. The mid-located fascia element is rearwardly inclined, at the same angle as the lower sales front. The bottom-located fascia element is hinge-fitted, at the level of its upper edge, to the sales display unit. The supplementary means of information, relating to the products presented in each subspace, are formed by slidable information boards which are inserted into slots provided in the fascia elements, and which are retained at each of their ends, at one end by a pull handle and at the other end by a projecting lug, or by any other means.

The invention provides advantages which, in essence, amount to the fact that a continuous front of product packages is continuously maintained, irrespective of the removal rate, for as long as at least one package remains, and to the fact that the customers can quickly identify the nature of the products presented in the sales section, can find the individual sales display unit containing the type of product which is being sought—thanks to the data appearing on the upper portion of the display unit—and can then narrow-down the search, utilizing the more precise data which appear on the informative fascia elements, and possibly utilizing supplementary means of information situated in the sub-spaces. In addition, having regard to its modular construction and its all-purpose design, this sales display unit can be utilized for building-up sales sections for all products which are packaged in bags, or on cards, or in boxes, subject to the reservation that they are dimensionally compatible.

The invention is explained in greater detail below, with the help of a drawing which represents only one embodiment, presented by way of example.

The invention is explained in greater detail below, with the help of a drawing which represents a view, in cavalier projection, of a sales display unit for products which are packaged in boxes, in operational condition, presented by way of example.

As can be seen on examining the FIGURE prepared from the drawing, this sales display unit is thus provided, in its upper sales space 1, with downward-inclined pegs 2 and, in its lower sales space 3, with upward-inclined pegs, 4, which are fitted with springs, 5, for inducing return movement of the box packages 6.

The front of the upper sales space 1 is vertical, whereas that of the lower sales space 3 is rearwardly inclined at an angle of approximately 45° , as is the fascia element, 7, which separates the two spaces, 1 and 3: an arrangement which enables the customers to utilize the sales display unit in a manner that is more rational and ergonomically more efficient, as is shown by the silhouettes 8 and 9.

The top-located fascia element 10 is forwardly inclined in order to make it easier to read the data 11 appearing thereon, and to facilitate utilization of the supplementary means of information, 12, which it carries, by customers who are seeking products in the sub-spaces situated in the upper region of the upper sales space 1.

In this example, the bottom-located fascia element is formed by a hinged panel, 13, which carries data 14, relating to the sub-spaces situated in the lower region of the lower space 3, and which is equipped with information boards 15, these being held captive in slots, 13*a*, which are provided in the panel 13, retention being effected by means of a pull handle 16 and a projecting lug 17. The supplementary means of information which are provided on the other two fascia elements are in every respect identical to those provided on the hinged panel 13, which forms the bottom-located fascia element.

Thus, the customers 8, interested by the products presented in the upper sales space 1, have the data and the means necessary for seeking and grasping the products corresponding to their needs, these data and means being both within their field of view and within their reach, and the customers 9, interested by the products presented in the lower sales space 3, enjoy the same advantages, having regard to the inclination of the sales front, subject to the reservation that, when they are interested in the products situated in the sales sub-spaces at the bottom, they will have to flex their legs to a certain extent and will also have to lift the hinged panel 13.

The customers 8 and 9 can, when they consider it necessary, consult the information boards 15 by pulling them towards themselves and then tipping them over into a position in which they can be read.

In one particular embodiment, these information boards are continuously subjected to a rearward returning force which is exerted by a spring, or by any other device of this general type.

It will be noticed that the intermediate fascia element 7 carries data, and is equipped, in its upper part, with information boards relating to the sub-spaces situated in the lower region of the upper sales space 1 and, in its lower part, with information boards relating to the sub-spaces situated in the upper region of the lower sales space 3.

The fascia elements 7, 10, and 13 are translucent, and are lit by light sources, such as fluorescent tubes, which are positioned inside the display unit, and which also light the sales fronts of the two spaces, 1 and 3.

In consequence, the customers can quickly identify the nature of the products which are presented in the sales section, find the individual display unit containing the type of product which they are seeking—thanks to the data appearing on the upper part of the top-located fascia element—and can then narrow-down the search, utilizing the more precise data which appear on the fascia elements and possibly utilizing the supplementary, use-related means of information appearing on the slidable information boards corresponding to each sub-space. The tasks of seeking products in the lower sales space 3 and of removing them therefrom are considerably facilitated by the fact that the packages containing these products, hung on the pegs within this space 3, are continuously subjected to an upward returning force which is exerted by a spring 5, and by the fact that the corresponding sales front is rearwardly inclined.

Having regard to its modular construction and its all-purpose design, the linear sales display unit according to the invention is intended for building-up sales sections for all products which are packaged in bags, or on cards, or in boxes, subject to the reservation that they are dimensionally compatible.

The fascia elements can be translucent, or opaque, and they can be lit either along their entire length, or over discrete portions only, and they can be utilized for displaying advertizing media, which may be static, mechanical, dynamic and/or electronic.

The spaces behind the fascia elements can be utilized for housing animation systems, information systems and instructional systems.

What is claimed is:

1. A sales display unit comprising an upper region including a first plurality of downwardly inclined substantially parallel pegs, whereby packaged products hanging from said first plurality of pegs will hang substantially vertically and will descend along said first plurality of pegs by means of gravity so that the initial one of said packaged products on each of said first plurality of pegs will automatically be presented at the forward ends of said first plurality of pegs in a substantially vertical plane, a lower region including a second plurality of upwardly inclined pegs including return spring means for urging packaged products hanging from said second plurality of pegs upwardly along said second plurality of pegs so that the initial one of said packaged products on each said second plurality of pegs will automatically be presented at the forward ends of said second plurality of pegs, an intermediate fascia element separating said upper region from said lower region providing an intermediate space behind said intermediate fascia element, said intermediate fascia element carrying information relevant to said packaged products in said upper and lower regions, an upper fascia element extending above said upper region providing an upper space behind said upper fascia element, said upper fascia element carrying information relevant to said packaged products in said upper region, and a lower fascia element extending below said lower region providing a lower space behind said lower fascia element, said lower fascia element carrying information relevant to said packaged products in said lower region, said lower fascia element including slot means and slidable information board means inserted within said slot means, said slidable information board means including an upper end and a lower end, and including handle means at said upper end of said slidable information board means, and projection means at said lower end of said slidable information board means for retaining said slidable information board means within said slot means and providing means for withdrawing said upper end of said slidable information board means from said upper surface of said lower fascia element so as to provide access to information contained upon said slidable information board means, whereby said intermediate, upper, and lower fascia elements may be illuminated, and said intermediate, upper, and lower spaces can provide housing for animation, information and instructional systems for said sales display unit.

2. The sales display unit of claim 1 wherein said lower region is inclined at an angle of approximately 45 degrees with respect to the vertical.

3. The sales display unit of claim 1 wherein said upper region and said lower region are in the form of a rectangle or a square.

4. The sales display unit of claim 3 wherein said upper region and said lower region have a side dimension not exceeding about 0.6 meters.

5. The sales display unit of claim 1 wherein said upper fascia element is inclined downwardly with respect to the vertical.

6. The sales display unit of claim 1 wherein said intermediate fascia element is inclined upwardly with respect to the vertical, and is inclined at an angle with respect to the vertical which is substantially the same as the angle at which said lower region is inclined with respect to the vertical.

7. The sales display unit of claim 1 including affixing means for affixing said lower fascia element to the lower end of said lower region.

* * * * *